US010681442B2

(12) United States Patent
Wang

(10) Patent No.: US 10,681,442 B2
(45) Date of Patent: Jun. 9, 2020

(54) GUARD APPARATUS AND INTERACTION METHOD FOR SOUND PICKUP DEVICE

(71) Applicant: Alibaba Group Holding Limited, Georgetown, Grand Cayman (KY)

(72) Inventor: Kang Wang, Beijing (CN)

(73) Assignee: Alibaba Group Holding Limited, Grand Cayman (KY)

( * ) Notice: Subject to any disclaimer, the term of this patent is extended or adjusted under 35 U.S.C. 154(b) by 0 days.

(21) Appl. No.: 16/164,506

(22) Filed: Oct. 18, 2018

(65) Prior Publication Data

US 2019/0116408 A1 Apr. 18, 2019

(30) Foreign Application Priority Data

Oct. 18, 2017 (CN) ..... 2017 1 0973112

(51) Int. Cl.
*H04R 1/04* (2006.01)
*H04R 1/08* (2006.01)
*H04R 3/00* (2006.01)

(52) U.S. Cl.
CPC ..... *H04R 1/04* (2013.01); *H04R 1/08* (2013.01); *H04R 1/086* (2013.01); *H04R 3/00* (2013.01); *H04R 2430/01* (2013.01)

(58) Field of Classification Search
CPC ..... H04R 1/025; H04R 1/026; H04R 1/021; H04R 1/086; H04R 2430/01; H04R 1/04; H04R 1/08; H04R 1/10; H04R 3/00; G06F 17/28
USPC ..... 340/6.1; 348/14.02, 375; 381/80, 86, 381/104, 150, 151, 361; 455/563; 704/201
See application file for complete search history.

(56) References Cited

U.S. PATENT DOCUMENTS

| | | | | |
|---|---|---|---|---|
| 4,881,123 | A * | 11/1989 | Chapple | H04R 3/00 381/104 |
| 5,225,944 | A | 7/1993 | Takao | |
| 6,111,964 | A * | 8/2000 | Ishibashi | B60R 11/0247 379/454 |
| 8,861,744 | B1 * | 10/2014 | Solomon | H04R 1/02 381/80 |
| 2003/0209383 | A1 | 11/2003 | Whitman Fox et al. | |
| 2004/0106398 | A1 | 6/2004 | Statham et al. | |
| 2005/0026560 | A1 | 2/2005 | Villaverde et al. | |
| 2005/0036814 | A1 | 2/2005 | Sim | |
| 2006/0018489 | A1 | 1/2006 | Piazza | |
| 2006/0166705 | A1 | 7/2006 | Seshadri et al. | |
| 2007/0009118 | A1 | 1/2007 | Kimura et al. | |
| 2007/0237344 | A1 | 10/2007 | Oster et al. | |
| 2008/0101576 | A1 | 5/2008 | Vernick | |
| 2009/0280870 | A1 | 11/2009 | Muttschall et al. | |
| 2010/0057444 | A1 * | 3/2010 | Cilia | G10L 19/012 704/201 |
| 2010/0066803 | A1 * | 3/2010 | Robotka | H04M 3/42 348/14.02 |

(Continued)

*Primary Examiner* — Gerald Gauthier

(57) ABSTRACT

Sound is blocked from entering a sound pickup area of a sound pickup device by placing a sound control structure adjacent to the sound pickup area. The sound control structure can include a sound absorbing material which can be placed in a first position that blocks sound, or in a second position that allows sound to pass. The sound control structure can alternately include levers that engage buttons on the sound pickup area that enable or disable the sound pickup area.

18 Claims, 11 Drawing Sheets

(56) References Cited

U.S. PATENT DOCUMENTS

| | | | | |
|---|---|---|---|---|
| 2010/0189273 | A1 | 7/2010 | Statham et al. | |
| 2011/0111805 | A1* | 5/2011 | Paquier | H04M 1/72552 455/563 |
| 2011/0198245 | A1 | 8/2011 | Soufan | |
| 2011/0228925 | A1 | 9/2011 | Birch | |
| 2012/0038460 | A1* | 2/2012 | Kawasaki | H04H 20/61 340/6.1 |
| 2012/0140944 | A1 | 6/2012 | Thiele | |
| 2012/0176535 | A1* | 7/2012 | Takeda | H04R 5/027 348/375 |
| 2013/0329610 | A1 | 12/2013 | Fraser | |
| 2014/0072148 | A1* | 3/2014 | Smith | H04R 1/08 381/151 |
| 2014/0148101 | A1 | 5/2014 | Seshadri et al. | |
| 2014/0341392 | A1 | 11/2014 | Lambert et al. | |
| 2015/0049892 | A1 | 2/2015 | Petersen et al. | |
| 2015/0146883 | A1 | 5/2015 | Palitsky et al. | |
| 2015/0167956 | A1 | 6/2015 | Vaidya | |
| 2015/0244336 | A1 | 8/2015 | Desmarais et al. | |
| 2015/0245155 | A1 | 8/2015 | Root et al. | |
| 2015/0350769 | A1 | 12/2015 | Sun et al. | |
| 2016/0073185 | A1* | 3/2016 | Kannappan | H04R 3/00 381/150 |
| 2016/0182697 | A1 | 6/2016 | Fields | |
| 2016/0233912 | A1* | 8/2016 | Thomas | H05K 9/0069 |
| 2016/0302002 | A1 | 10/2016 | Lambert et al. | |
| 2016/0323668 | A1 | 11/2016 | Abraham et al. | |
| 2017/0048635 | A1 | 2/2017 | Cilia | |
| 2017/0142511 | A1* | 5/2017 | Dennis | H04R 1/1083 |
| 2017/0201818 | A1 | 7/2017 | Smith | |
| 2017/0245076 | A1 | 8/2017 | Kusano et al. | |
| 2018/0054666 | A1* | 2/2018 | Utsunomiya | H04R 1/083 |
| 2018/0160224 | A1 | 6/2018 | Graham et al. | |
| 2018/0329896 | A1* | 11/2018 | Goethals | G06F 40/58 |
| 2019/0116408 | A1* | 4/2019 | Wang | H04R 1/04 |

* cited by examiner

GUARD APPARATUS AND INTERACTION METHOD FOR SOUND PICKUP DEVICE

CROSS-REFERENCE TO RELATED APPLICATIONS

This application claims priority to Chinese Patent Application No. 201710973112.9, filed on Oct. 18, 2017, which is incorporated herein by reference in its entirety.

BACKGROUND OF THE INVENTION

1. Field of the Invention

The present application relates to the field of terminal technology and, in particular, to a guard apparatus and an interaction method for a sound pickup device.

2. Description of the Related Art

With the development of terminal technology, devices with sound pickup functions such as smart speakers have become increasingly popular. The sound pickup device collects sound data from the surrounding environment, and then provides services to a user according to the collected sound data, thereby achieving the automation and intelligentization of the user's life. On the other hand, the sound pickup device may also be maliciously controlled to collect sound data without a user's knowledge, compromising the user's privacy with a low security level.

A sound pickup device in the prior art is usually provided with a mute switch. When the mute switch is on, the sound pickup device cannot collect sound. However, in practical applications, the mute switch may also be hacked and disabled, making it difficult to ensure that the sound pickup device is not picking up sound. In other words, the security concerns of the sound pickup device cannot be effectively resolved.

SUMMARY OF THE INVENTION

The present invention provides a guarded sound pickup device that allows users to control when the sound pickup device is active. The guarded sound pickup device includes a sound pickup device that has a sound pickup area, and a sound control structure. The guarded sound pickup device also includes a fixing member that movably connects the sound control structure to the sound pickup device. The sound control structure is movable between a first position adjacent to the sound pickup area and a second position spaced apart from the sound pickup area.

The present invention also provides a method of operating a guarded sound pickup device. The method places a sound control structure in a first position adjacent to a sound pickup area of a sound pickup device to limit sound from entering the sound pickup area. The method also moves the sound control structure away from the sound pickup area.

The present invention also provides a non-transitory computer-readable medium having computer executable instructions for performing a method for operating a guarded sound pickup device. The method places a sound control structure in a first position adjacent to a sound pickup area of a sound pickup device to limit sound from entering the sound pickup area. The method also moves the sound control structure away from the sound pickup area.

A better understanding of the features and advantages of the present invention will be obtained by reference to the following detailed description and accompanying drawings which set forth an illustrative embodiment in which the principals of the invention are utilized.

BRIEF DESCRIPTION OF THE DRAWINGS

Those skilled in the art will have a better understanding of other advantages and benefits of the present invention by reading the following detailed description of the preferred embodiments. The accompanying drawings are for the purposes of illustrating the preferred embodiments only, and are not to be considered as limitations on the present application. Moreover, in the accompanying drawings, the same reference symbols are used to represent the same parts.

FIG. 1A is a side view of guarded sound pickup device 100. FIG. 1B is a cross-sectional view taken along line 1B-1B of FIG. 1A.

FIG. 2A is a perspective view of sound pickup device 110. FIG. 2B is a perspective view of guarded sound pickup device 100 with sound control structure 114 in a closed sound blocking position. FIG. 2C is a perspective view of guarded sound pickup device 100 with sound control structure 114 in an open sound passing position.

FIG. 4A is a perspective view of guarded sound pickup device 300 with sound control structure 114 in a closed sound blocking position. FIG. 4B is a perspective view of guarded sound pickup device 300 with sound control structure 114 in an open sound passing position.

FIG. 9A is a perspective view of guarded sound pickup device 800 with sound control structure 114 in a closed sound blocking position. FIG. 9B is a perspective view of guarded sound pickup device 800 in an open intermediate position. FIG. 9C is a perspective view of guarded sound pickup device 800 with sound control structure 114 in an closed sound passing position.

DETAILED DESCRIPTION OF THE INVENTION

Exemplary embodiments of the present application will be described below in more detail with reference to the accompanying drawings. Although the accompanying drawings show exemplary embodiments of the present application, it should be understood that the present application may be implemented in various forms and should not be limited by the embodiments described herein. Instead, these embodiments are provided so that the present application will be better understood, and the scope of the present application can be fully conveyed to a person skilled in the art.

The sound pickup device involved in the embodiment of the present application may include a device having a sound pickup function, such as a smart speaker, a microphone, a mobile phone, a tablet computer, a wearable device, and similar devices.

In order to prevent the sound pickup device from collecting sounds and compromising user privacy without the user's knowledge, a guard apparatus for the above-mentioned sound pickup device is provided, which prevents the sound pickup device from collecting sounds from the surrounding environment. Specifically, the prevention can be done based on various possible principles, such as blocking the transmission of sound to the sound pickup device, cutting off the power source of the sound pickup device, and adding additional interference sounds.

The present application can be applied to scenarios where eavesdropping or leakage is to be avoided. The sound pickup device can collect sounds from the surrounding environment, thereby achieving the automated and intelligent life style for the user. However, if there is no restriction on the sound pickup function, the user's personal privacy may be compromised.

Therefore, in order to improve the security of a sound pickup device, a guard apparatus can be arranged on the sound pickup device. A sound absorbing structure is used to stop the sound pickup device from collecting sound, and a fixing member is further used to fix the sound absorbing structure to the sound pickup device.

The guard apparatus can also control the mute state of the sound pickup device. For example, a smart speaker can also be used as a voicing device that makes sound, which might disturb the user late at night. The guard apparatus can therefore also be used to prevent the voicing device from making sound.

Figure 1A:
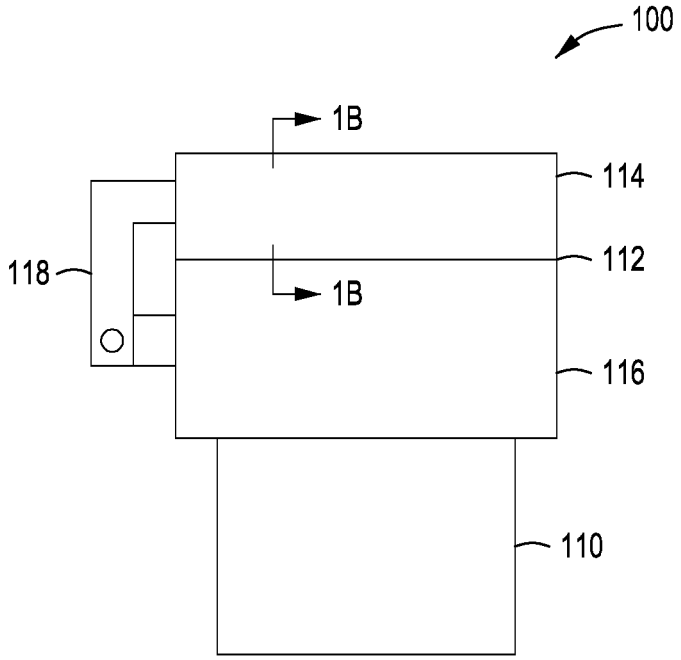
FIGS. 1A-1B are views illustrating an example of a guarded sound pickup device 100 in accordance with the present invention.
Figure 1B:
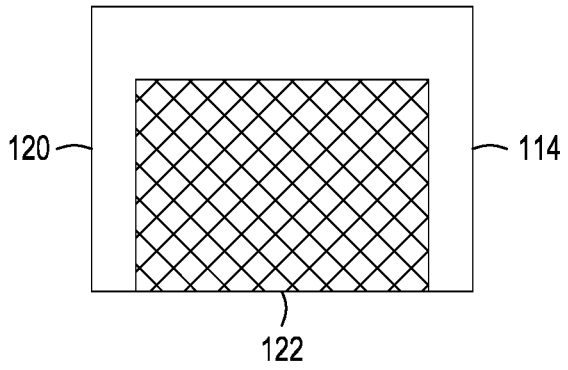

FIGS. 1A-1B show views that illustrate an example of a guarded sound pickup device 100 in accordance with the present invention. FIG. 1A shows a side view of guarded sound pickup device 100, while FIG. 1B shows a cross-sectional view of guarded sound pickup device 100 taken along line 1B-1B of FIG. 1A.

As shown in the FIG. 1A example, guarded sound pickup device 100 includes a sound pickup device 110, such as a microphone, and a guard apparatus 112 that is connected to sound pickup device 110. Guard apparatus 112 includes a sound control structure 114 that stops sound pickup device 110 from collecting sound.

Guard apparatus 112 also includes a fixing member 116 that fixes sound control structure 114 to sound pickup device 110. Fixing member 116 can prevent sound control structure 114 from becoming loose or coming off from sound pickup device 110. The effect and reliability in stopping sound pickup device 110 from collecting sound is therefore enhanced. Fixing member 116 may be fixedly connected to sound pickup device 110 either detachably or undetachably, such as with a screw connection, bonding, welding, an elastic deformation connection, a latch connection, or a similar connection.

In the FIG. 1A example, fixing member 116 includes a hinge structure 118 that is connected to sound control structure 114 to allow sound control structure 114 to rotate away from fixing member 116 and the sound pickup area of sound pickup device 110. Hinge structure 118 facilitates the attachment or detachment of sound control structure 114 to and from the sound pickup area of sound pickup device 110 to stop sound pickup device 110 from picking up sound, or to restore the sound pickup function of device 110 so as to improve the reliability of guarded sound pickup device 100. Optionally, hinge structure 118 can be a rotation shaft that fits within openings integrally formed in sound control structure 114 and fixing member 116 to provide a hinge function.

In the FIGS. 1A-1B example, sound pickup device 110 is a regular cylinder with a microphone provided on the top of the cylinder. In addition, fixing member 116 of guard apparatus 112 is a sleeve having an inner diameter larger than the diameter of the cylinder. The inner side of the sleeve is provided with an elastic material. When the elastic material is elastically deformed, the inner diameter of the sleeve is smaller than the diameter of the cylinder. When sound pickup device 110 is placed in the sleeve, the elastic material is elastically deformed to fix sound pickup device 110 in the sleeve.

Sound control structure 114 can prevent sound pickup device 110 from collecting sound unrestrictedly, avoiding compromising user privacy and improving the security of sound pickup device 110. Fixing member 116 can be fixedly connected to sound control structure 114 detachably or undetachably. Further, fixing member 116 and sound control structure 114 can be integrally formed.

Optionally, in order to ensure that sound pickup device 110 is capable of picking up sound when device 110 is used in a normal condition and does not pick up sound when not in use, sound control structure 114 stops sound pickup device 110 from picking up sound when it is adjacent to the sound pickup area of sound pickup device 110. That is, when sound control structure 114 is spaced away from the sound pickup area of sound pickup device 110, sound control structure 114 does not stop sound pickup device 110 from picking up sound.

When sound pickup device 110 is used in a normal condition, a user can control sound control structure 114 to be spaced away from the sound pickup area of sound pickup device 110 so that sound pickup device 110 can pick up sound normally. When done, the user may control sound control structure 114 to cover the sound pickup area of sound pickup device 110 so as to stop sound pickup device 110 from picking up sound.

As shown in the FIG. 1B example, sound control structure 114 is implemented with an upper cover 120 and a sound absorbing material 122. Upper cover 120 includes a circular top part and a cylindrical side wall that covers the sound pickup area. Sound absorbing material 122 is disposed within a concave surface formed with the circular top part and the cylindrical side wall. The shape of the sound absorbing material 122 is circular and matches the shape of the sound pickup area of the sound pickup device 110.

Upper cover 120 and sound absorbing material 122 enable sound control structure 114 to block sound from the sound pickup area of sound pickup device 110. Sound absorbing material 122 can include a material capable of absorbing sound, such as wave sponge, plastic foam, sponge, fiber blanket, industrial felt, aluminum silicate cotton, petroleum fiber cotton, glass fiber cotton, or a similar material.

Figure 2A:
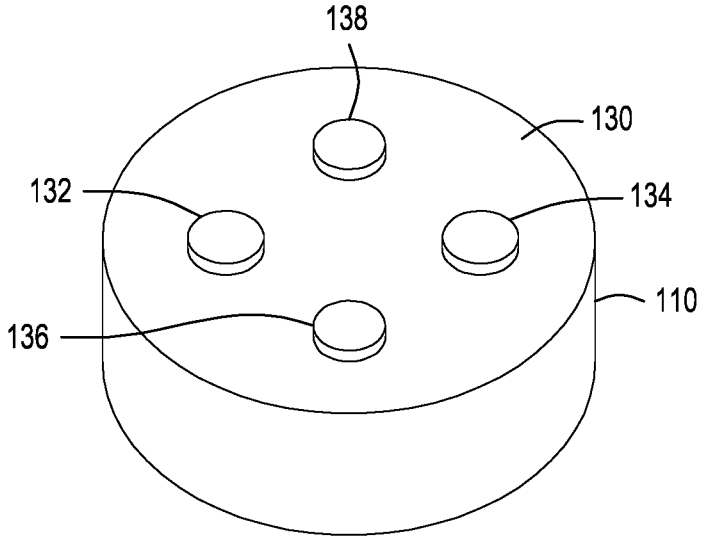
FIGS. 2A-2C are views further illustrating guarded sound pickup device 100 in accordance with the present invention.
Figure 2B:
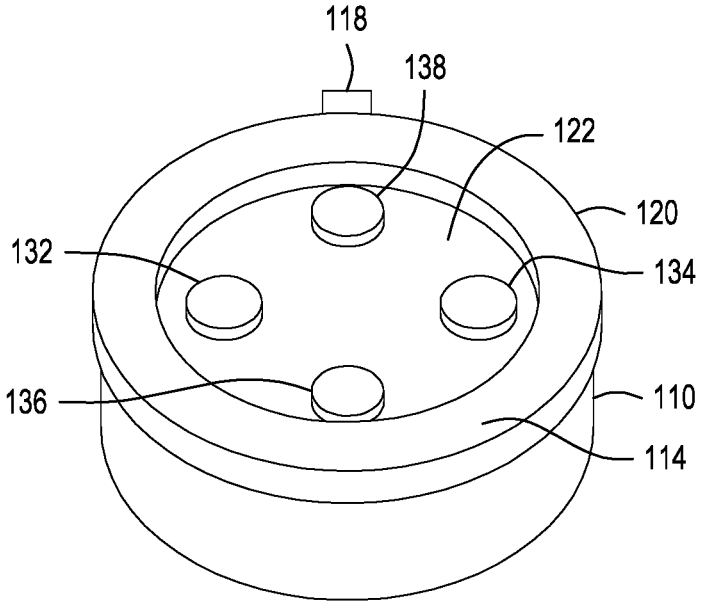
Figure 2C:
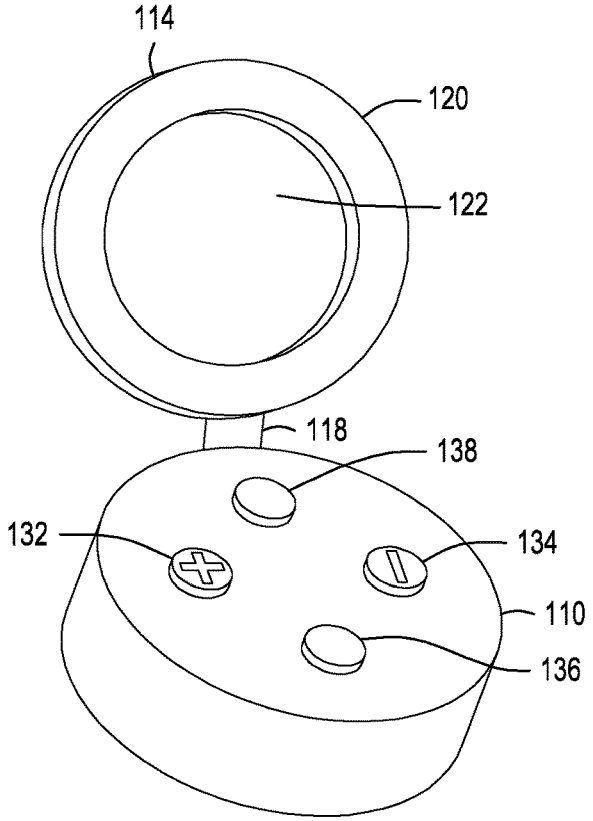

FIGS. 2A-2C show views that further illustrate guarded sound pickup device 100 in accordance with the present invention. FIG. 2A shows a perspective view of sound pickup device 110, FIG. 2B shows a perspective view of guarded sound pickup device 100 with sound control structure 114 in a closed sound blocking position, and FIG. 2C shows a perspective view of guarded sound pickup device 100 with sound control structure 114 in an open sound passing position.

As shown in FIG. 2A, sound pickup device 110 has a sound pickup area 130 at the top part of sound pickup device 110. In addition, the top part further includes four buttons: an increase volume "+" button 132, a decrease volume "–" button 134, a "mute" button 136, and a "sound pickup" button 138. Sound pickup button 138 controls sound pickup device 110 to pick up sound.

As shown in FIG. 2B, sound control structure 114 is in a closed sound blocking position. (Sound absorbing material 122 is shown as transparent for illustration purposes only.) When sound control structure 114 is rotated (including controlling the rotation manually or electrically) to be in a closed sound blocking position so that upper cover 120 of the guard apparatus is positioned adjacent to the sound pickup area of sound pickup device 110, sound pickup device 110 is stopped from picking up sound.

As shown in FIG. 2C, sound control structure 114 is in an open sound passing position. (Sound absorbing material 122 is shown as transparent for illustration purposes only.) When sound control structure 114 is rotated (including controlling the rotation manually or electrically) to be in an open sound passing position so that upper cover 120 of the guard apparatus is positioned away from the sound pickup area of sound pickup device 110, sound pickup device 110 is allowed to pick up sound.

Figure 3:
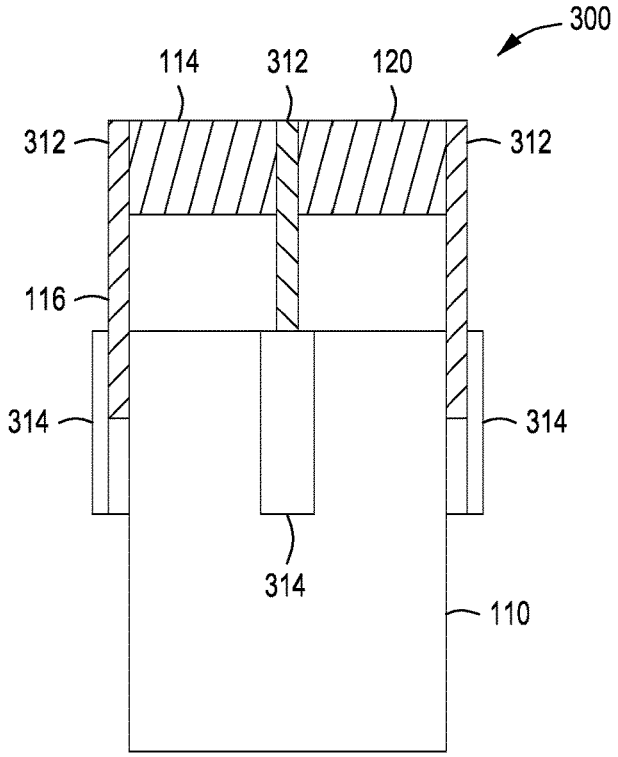
FIG. 3 is a side view illustrating an example of a guarded sound pickup device 300 in accordance with an alternate embodiment of the present invention.

FIG. 3 shows a side view that illustrates an example of a guarded sound pickup device 300 in accordance with an alternate embodiment of the present invention. Guarded sound pickup device 300 is similar to guarded sound pickup device 100 and, as a result, utilizes the same reference numerals to designate the structures which are common to both pickup devices.

As shown in FIG. 3, guarded sound pickup device 300 differs from guarded sound pickup device 100 in that guarded sound pickup device 300 implements fixing member 116 as a snap-fit structure, which eliminates the need for a hinge structure. As further shown in FIG. 3, the snap-fit structure includes a number of pillars 312 that are connected to upper cover 120 of sound control structure 114, and a number of pillar grooves 314 that are connected to sound pickup device 110.

In the FIG. 3 example, the pillar grooves 314 are illustrated as separate structures. Alternately, the pillar grooves 314 may be connected together with a band to facilitate connection to sound pickup device 110. Further alternately, fixing member 116 can be omitted when the pillars 312 are formed as part of sound control structure 114, and the pillar grooves 314 are formed as part of sound pickup device 110. Alternately, the pillars 312 can be formed as part of sound control structure 114, while fixing member 116 includes the pillar grooves 314 or the pillar grooves 314 connected to an elastically deformable band.

In operation, the pillars 314 slide within the pillar grooves 316 such that sound control structure 114 can move towards and contact the sound pickup area of sound pickup device 110, or move away and be spaced apart from the sound pickup area of sound pickup device 110. In the present example, the pillars 314 have slight protrusions at the bottoms, while the pillar grooves 316 have slight indentions at both the bottom and top of the grooves such that when the protrusions are engaged with the indentions free movement of the pillars 314 is inhibited.

As can be seen from FIG. 3, the pillars 314 are disposed at the edge of sound control structure 114, and the pillar grooves 316 are correspondingly disposed on a side surface of sound pickup device 110. Alternately, the pillar grooves 316 may be disposed at the edge of sound control structure 114, and the pillars may be correspondingly disposed on the side surface of sound pickup device 110.

Figure 4A:
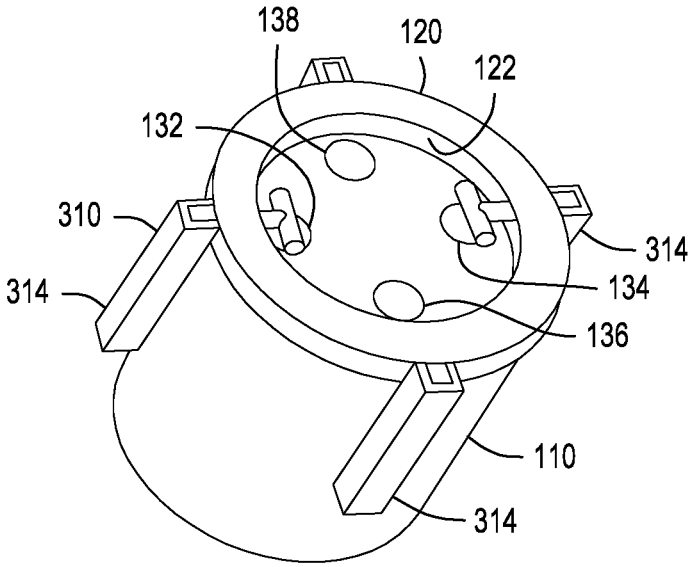
FIGS. 4A-4B are perspective views further illustrating guarded sound pickup device 300 in accordance with the present invention.
Figure 4B:
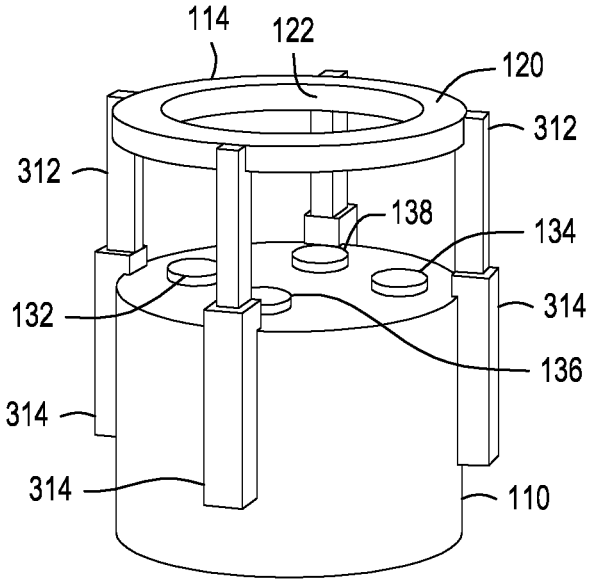

FIGS. 4A-4B show perspective views that further illustrate guarded sound pickup device 300 in accordance with the present invention. FIG. 4A shows a perspective view of guarded sound pickup device 300 with sound control structure 114 in a closed sound blocking position, and FIG. 4B shows a perspective view of guarded sound pickup device 300 with sound control structure 114 in an open sound passing position.

As shown in FIG. 4A, sound control structure 114 is in a closed sound blocking position. (Sound absorbing material 122 is shown as transparent for illustration purposes only.) When sound control structure 114 is longitudinally pushed (including controlling the push manually or electrically) so that upper cover 120 of sound control structure 114 is positioned adjacent to the sound pickup area of sound pickup device 110, sound pickup device 110 is stopped from picking up sound.

As shown in FIG. 4B, sound control structure 114 is in an open sound passing position. (Sound absorbing material 122 is shown as transparent for illustration purposes only.) When sound control structure 114 is longitudinally pulled (including controlling the pull manually or electrically) so that upper cover 120 of sound control structure 114 is positioned away from the sound pickup area of sound pickup device 110, sound pickup device 110 is allowed to pick up sound.

In the example of FIGS. 4A-4B, four pillars 312 and four pillar grooves 314 are utilized. Alternately, additional or fewer pillars 312 and pillar grooves 314 can be used. By means of the four snap-fit structures, the pillars 312 are controlled (manually or electrically) to be snap-fitted with the pillar grooves 314. That is, sound control structure 114 can be positioned adjacent to the sound pickup area of sound pickup device 110 to stop sound pickup device 110 from picking up sound. In addition, the pillars 312 can be controlled to be away from the pillar grooves 314. That is, sound control structure 114 can be detached from the sound pickup area of sound pickup device 110 as shown in FIG. 4B so that sound pickup device 110 can pick up sound. Alternately, snap-fit structure 310 can be replaced with other forms of latching connections.

Optionally, sound control structure 114 can be a shrinkable structure of an adjustable size because different sound pickup devices may have sound pickup areas with different shapes. The shrinkable structure of an adjustable size ensures that the guard apparatus 112 can better protect different sound pickup devices and improve the reliability in stopping the sound pickup device from picking up sound. The sound absorbing material adjusts its size as the sound absorbing structure changes so as to match the shape of the sound pickup area.

Sound control structure 114 can include a plurality of applicable substructures. Different numbers and shapes of substructures can be assembled to obtain sound absorbing structures having different sizes and shapes. Alternatively, the sound absorbing structure may be made of a deformable material, such as a relatively soft metal, which changes the shape and size of the sound absorbing structure through the contraction or extension of the material itself.

Because the better attachment of the sound absorbing material to the sound pickup area, the more effectively the sound is stopped from being transmitted to the sound pickup device, which in turn leads to a better sound-pickup blocking effect of the sound pickup device. Optionally, in order to further improve the contact between the sound absorbing material and the sound pickup area, the sound absorbing material can be a soft material so as to match the shape of the sound pickup area. For example, the sound absorbing material may include plastic foam or wave sponge.

Optionally, in order to quickly control whether to stop the sound pickup device from picking up sound and avoid mechanical wear caused by long-term use, which causes difficulties in accurately controlling the sound absorbing structure to be attached to or detached from the sound pickup area, further reducing the accuracy and reliability in controlling whether to stop the sound pickup of the sound pickup device, the sound absorbing structure can further include a power supply and a power switch. When the power is turned on, the sound absorbing material has a sound absorbing function, and when the power is turned off, the sound absorbing material does not have the sound absorbing function.

Because the sound absorbing structure can control the sound absorbing function by turning on/off the power supply, in this case, the sound absorbing structure may not be disposed separately from the sound pickup area of the sound pickup device. For example, the guard apparatus may not include the aforementioned hinge/rotation shaft or the snap-fit structure.

The power supply may include a direct current power supply or an alternate current power supply. The power source may be a dry battery for portability. Alternatively, in actual applications, the sound absorbing structure may not include the power supply. Instead, the sound absorbing structure can be electrically connected to the sound pickup device. That is, the sound pickup device provides power to the sound absorbing structure. The power switch may be a physical button or a virtual button on a touch screen. Accordingly, a user may perform a key operation or touch operation to control the power switch to be on or off.

Optionally, in order to easily control whether the upper cover is attached to the sound pickup area of the sound pickup device to determine whether to stop the sound pickup device from picking up sound, the sound absorbing structure can be a sleeve structure. When the sleeve structure is located at a first rotation position, the sound absorbing material is shown. When the sleeve structure is located at a second rotation position, the sound absorbing material is concealed.

Concealing the sound absorbing material is to show the sound pickup area, i.e., the sound absorbing structure being detached from the sound pickup area. On the other hand, showing the sound absorbing material is to attach the sound pickup area to the sound absorbing material, i.e., the sound absorbing mechanism being connected to the sound pickup area.

Figure 5A:
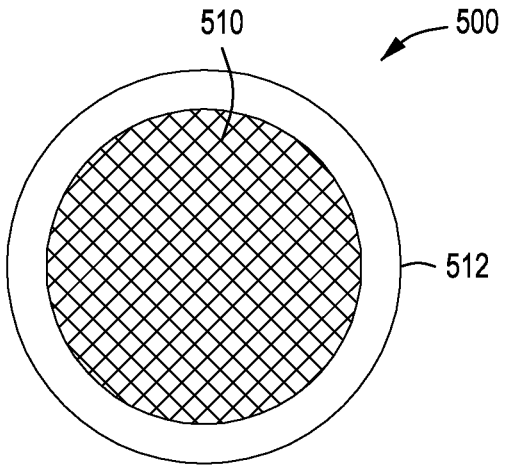
FIGS. 5A-5B are top views illustrating an example of a guarded sound pickup device 500 in accordance with the present invention.
Figure 5B:
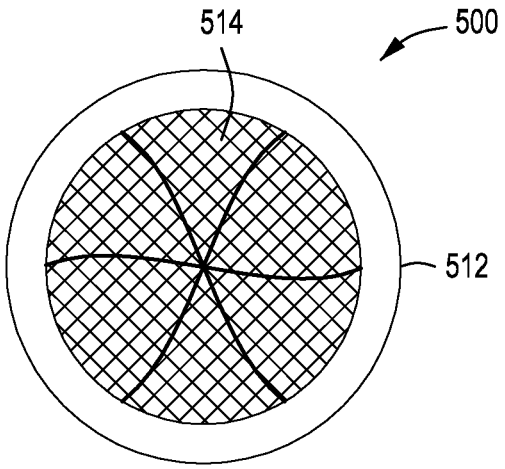

FIGS. 5A-5B show top views that illustrate an example of a guarded sound pickup device 500 in accordance with the present invention. As shown in FIG. 5A, guarded sound pickup device 500 includes a sound pickup device 510 and a guard apparatus 512 that is connected to sound pickup device 510. As shown in FIG. 5B, guard apparatus 512 includes a sound control structure 514 that stops sound pickup device 510 from collecting sound.

Sound pickup device 510 is a regular circular cylinder. The sound pickup area is disposed at the top part of sound pickup device 510. Sound control structure 514 is a sleeve disposed outside sound pickup device 510. In FIG. 5A, sound control structure 514 is located at a second rotation position where sound control structure 514 is concealed and the sound pickup area is not guarded. As shown in FIG. 5B, when sound control structure 514 is located at the first rotation position located, the sound control structure 514 is shown so as to guard the sound pickup area.

Figure 6A:
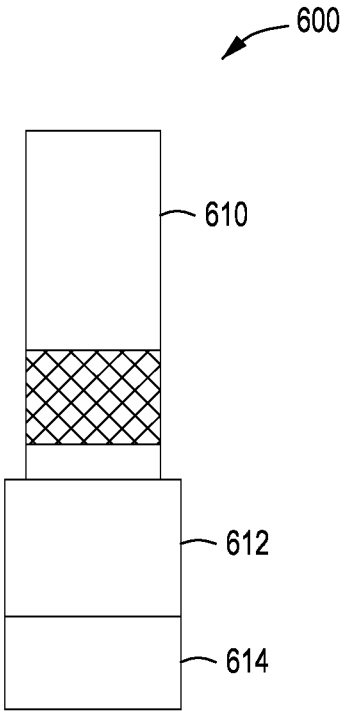
FIGS. 6A-6B are top views illustrating an example of a guarded sound pickup device 600 in accordance with the present invention.
Figure 6B:
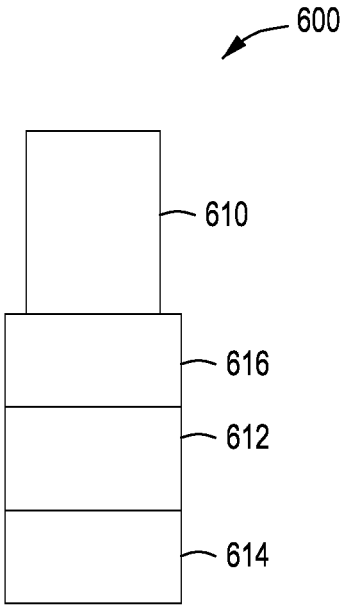

FIGS. 6A-6B show top views that illustrate an example of a guarded sound pickup device 600 in accordance with the present invention. As shown in FIG. 6A, guarded sound pickup device 600 includes a sound pickup device 610, a sound control structure 612, and a fixing member 614. As shown in FIG. 6B, sound control structure 612 includes a sound absorbing material 616.

Sound pickup device 610 is a prism with an irregular bottom surface. The sound pickup area is positioned in the middle of the pillar. Sound control structure 612 is a sleeve disposed outside sound pickup device 610. In this configuration, as shown in FIG. 6A, sound control structure 612 is located at a second rotation position where sound absorbing material 616 is concealed. That is, the sound pickup area is not guarded. As shown in FIG. 6B, when sound control structure 612 is located at the first rotation position, sound absorbing material 616 is shown so as to guard the sound pickup area.

In actual applications, fixing member 614 can be provided as a sleeve structure. When fixing member 614 is located at the first rotation position, sound absorbing material 616 is shown. When fixing member 614 is located at the second rotation position, sound absorbing material 616 is concealed.

Optionally, in order to easily control whether sound control structure 612 contacts the sound pickup area of sound pickup device 610 to determine whether to stop sound pickup device 610 from picking up sound, fixing member 614 can include a drive structure and a control apparatus. The drive structure is used to control fixing member 614 to move so as to attach or detach sound control structure 612 to or from the sound pickup area. The control apparatus is used to control, according to a control instruction, the drive structure to operate.

The drive structure can include a motor, such as an electric motor, to convert other energy into mechanical energy to control the movement of fixing member 614. The control apparatus may include a physical button, a virtual button on a display screen, or a biometric component (such as a voice recognition component, a fingerprint recognition component, a face recognition component, or an iris recognition component).

The control instruction indicates control of the drive structure. Because control apparatuses are different, the control instruction may be triggered by different user operations, such as a button operation, a touch operation, or inputting a biometric feature such as a fingerprint, a sound, a face image, or an iris image.

Optionally, in order to help the user to remotely control and find out whether the sound absorbing structure is in contact with the sound pickup area of the sound pickup device to improve the guarding reliability of the sound pickup device, the control device may include at least one of a Bluetooth chip, an infrared chip, and a WIFI chip. Accordingly, the control apparatus can receive control instructions from other electronic devices via the Bluetooth chip, the infrared chip, or the WIFI chip to control the drive structure to move. Other electronic devices may include sound pickup devices provided with the guard apparatus, such as a mobile phone, a tablet, a wearable device, or a remote controller.

Optionally, because the sound pickup device often needs electric power to properly pick up sound and in order to improve the sound-pickup blocking reliability of the sound pickup device, the sound control structure may include an electrical control device and a connector. The electrical control device is connected to a power supply of the sound pickup device via the connector, and is configured to turn off the power of the sound pickup device so as to stop the sound pickup device from collecting sound.

The electrical control device can include a relay. The electrical control device can also be disposed between the sound pickup device and the microphone so that the electrical control device can be used to control whether the power of the microphone is on or off.

If noise interference is present in the sound pickup process of the sound pickup device, the sound picked up by the sound pickup device can also include a great deal of noise, thereby greatly reducing the sound pickup effect of the sound pickup device and avoiding compromising user privacy. Therefore, in order to improve the sound-pickup blocking reliability of the sound pickup device, optionally, the sound absorbing structure can include a noise interference component. The noise interference component can transmit acoustic or electromagnetic waves to interfere with the sound pickup process of the sound pickup device.

Figure 7:
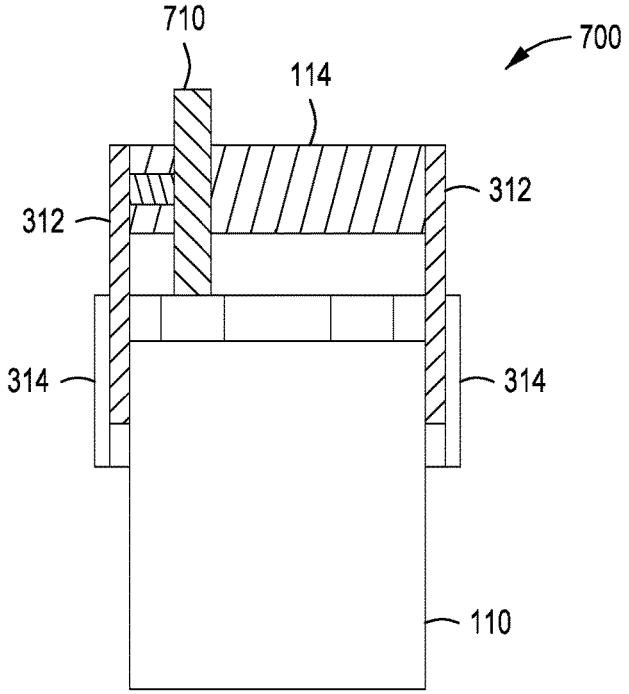
FIG. 7 is a cross-sectional view illustrating an example of a guarded sound pickup device 700 in accordance with an alternate embodiment of the present invention.

FIG. 7 shows a cross-sectional view that illustrates an example of a guarded sound pickup device 700 in accordance with an alternate embodiment of the present invention. Guarded sound pickup device 700 is similar to guarded sound pickup device 300 and, as a result, utilizes the same reference numerals to designate the structures which are common to both pickup devices.

As shown in FIG. 7, guarded sound pickup device 700 differs from guarded sound pickup device 300 in that guarded sound pickup device 700 implements sound control structure 114 as a ring. Pillars 312 can be integrally formed as part of sound control structure 114, or can be attached to sound control structure 114 as part of fixing member 116.

In addition, guarded sound pickup device 700 also differs from guarded sound pickup device 300 in that guarded sound pickup device 700 includes a mute control lever 710 that is provided at a position that corresponds with mute button 136. Mute control lever 710 includes a rotatable lever body and a lever head arranged orthonogally to the lever body.

As shown in the FIG. 7 example, when sound pickup device 110 is stopped from picking up sound, sound control structure 114 is in a closed position adjacent to the sound pickup area, while the lever head of mute control lever 710 is vertically positioned and in contact with mute button 136. When sound pickup device 110 is not stopped from picking up sound, sound control structure 114 is in the closed position adjacent to the sound pickup area, while the lever head of mute control lever 710 is horizontally positioned and no longer in contact with mute button 136.

When motor driven and a control instruction is received to stop sound pickup, the motor raises sound control structure 114, and the lever body of mute control lever 710 rotates so as to enable the lever head to be in a vertical state. The motor then lowers sound control structure 114 such that the lever head of mute control lever 710 makes contact with mute button 136.

When a control instruction is received to again not stop sound pickup, the motor again raises sound control structure 114, and the lever body of mute control lever 710 rotates so as to enable the lever head to be in a horizontal state. The motor then lowers sound control structure 114 to a closed position where the lever head of mute control lever 710 remains spaced apart from mute button 136.

Figure 8:
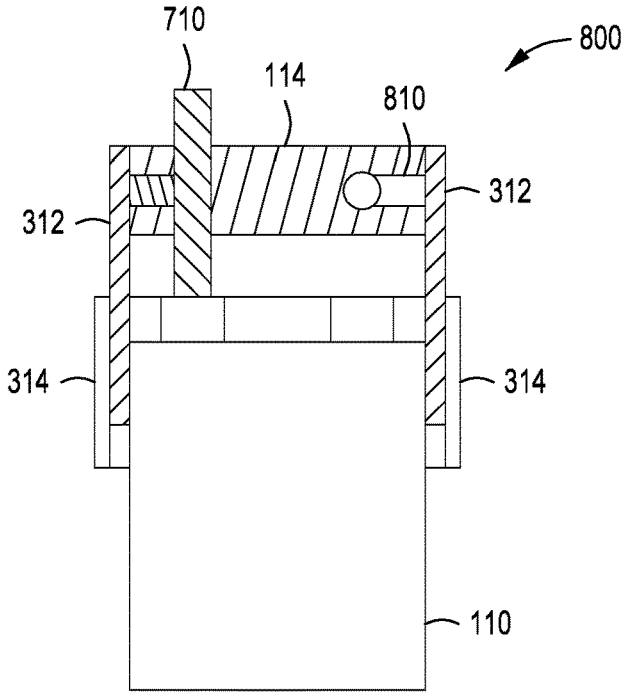
FIG. 8 is a cross-sectional view illustrating an example of a guarded sound pickup device 800 in accordance with an alternate embodiment of the present invention.

FIG. 8 shows a cross-sectional view that illustrates an example of a guarded sound pickup device 800 in accordance with an alternate embodiment of the present invention. Guarded sound pickup device 800 is similar to guarded sound pickup device 700 and, as a result, utilizes the same reference numerals to designate the structures which are common to both pickup devices.

As shown in FIG. 8, guarded sound pickup device 800 differs from guarded sound pickup device 700 in that guarded sound pickup device 800 includes a sound pickup control lever 810 that is provided at a position that corresponds with sound pickup button 138. The form of sound pickup control lever 810 and the method of controlling the sound pickup control lever 810 can be the same as the form of mute control lever 710 and the method of controlling mute control lever 710.

In the present example, when sound-pickup button 138 of sound pickup device 110 is pressed, sound pickup device 110 can then pick up sound. When vertically positioned with sound control structure 114 in a closed position adjacent to the sound pickup area, sound pickup control lever 810 is in contact with sound pickup button 138 of sound pickup device 110 so that sound pickup device 110 is in a sound-pickup ON state. When horizontally positioned with sound control structure 114 in the closed position adjacent to the sound pickup area, sound pickup control lever 810 is spaced apart from sound pickup button 138 of sound pickup device 110 so that sound pickup device 110 is in a sound-pickup OFF state.

In order to further improve the sound-pickup reliability of sound pickup device 110, sound control structure 114 can use mute control lever 710 and sound pickup control lever 810 at the same time. When sound control structure 114 is in the closed position adjacent to the sound pickup area, sound pickup control lever is spaced apart from sound pickup button 138 at the same time that mute control lever 810 is in contact with mute button 136 so as to stop sound pickup device 110 from picking up sound.

As shown in FIG. 8, mute control lever 710 is in contact with mute button 136, while sound pickup control lever 810 is spaced apart from sound pickup button 138. The lever head of mute control lever 710 is in a vertical state, whereas the lever head of sound pickup control lever 810 is in a horizontal state.

Figure 9A:
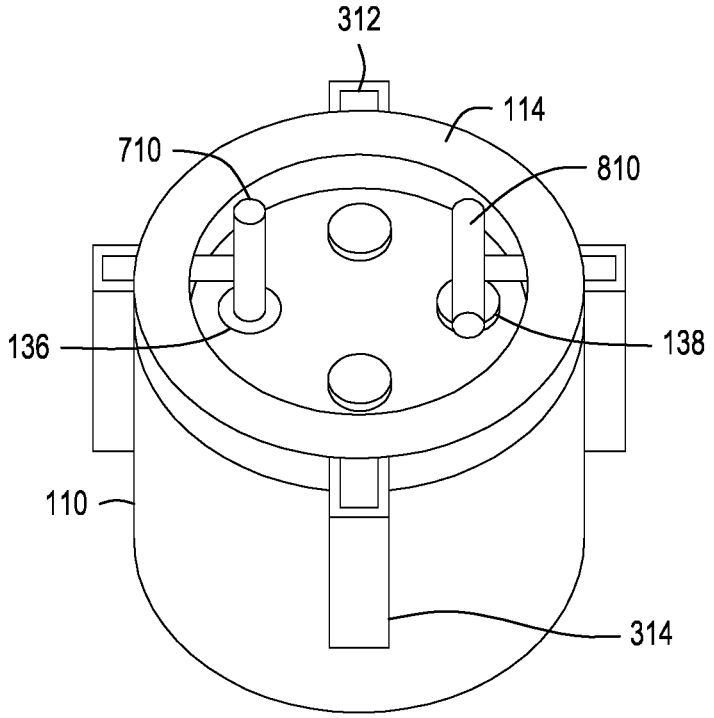
FIGS. 9A-9C are perspective views illustrating the operation of guarded sound pickup device 800 in accordance with the present invention.
Figure 9B:
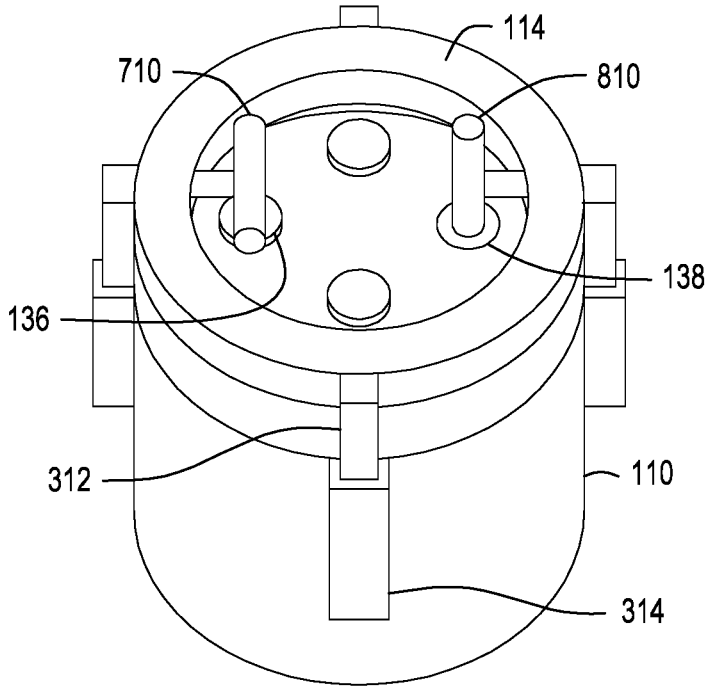
Figure 9C:
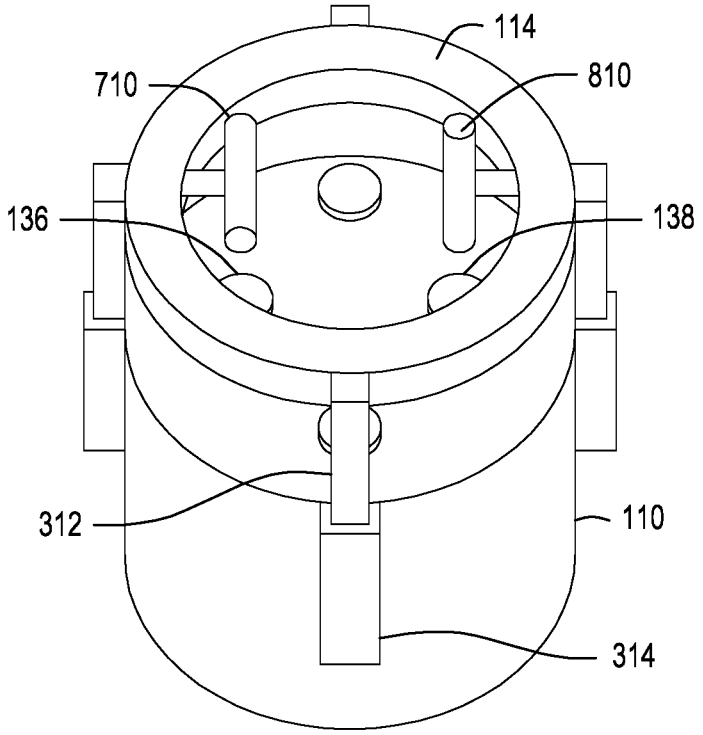

FIGS. 9A-9C show perspective views that illustrate the operation of guarded sound pickup device 800 in accordance with the present invention. FIG. 9A shows a perspective view of guarded sound pickup device 800 with sound control structure 114 in a closed sound blocking position, FIG. 9B shows a perspective view of guarded sound pickup device 800 in an open intermediate position, and FIG. 9C shows a perspective view of guarded sound pickup device 800 with sound control structure 114 in an closed sound passing position.

As shown in FIG. 9A, in the closed sound blocking position, the lever head of mute control lever 710 is vertical and in contact with mute button 136, while the lever head of sound pickup control lever 810 is horizontal and spaced apart from sound pickup button 138. To change from the closed sound blocking position to the closed sound passing position, sound control structure 114 moves away from sound pickup device 110 to an open intermediate position as shown in FIG. 9B.

In the intermediate position, mute control lever 710 is rotated such that the lever head of mute control lever 710 is horizontal, while sound pickup control lever 810 is rotated such that the lever head of sound pickup control lever 810 is now vertical. Next, as shown in FIG. 9C, sound control structure 114 moves towards sound pickup device 110 until sound pickup control lever 810 contacts sound pickup button 138. At this point, mute control lever 710 is horizontal and spaced apart from mute button 136.

In the embodiments of the present application, first a guard apparatus for a sound pickup device comprises a sound absorbing structure and a fixing member. The sound absorbing structure can stop the sound pickup device from collecting sound, thereby avoiding compromising user privacy when the sound pickup device unlimitedly collects sound and enhancing the security level of the sound pickup devices. The fixing member can fix the guard apparatus to the sound pickup device, so as to prevent the guard apparatus from coming off from the sound pickup device, thereby improving the effect of the guard apparatus device in stopping the sound pickup device from collecting sound.

Then, the sound absorbing structure includes an upper cover and a sound absorbing material. The upper cover can cover the sound pickup area. The sound absorbing material matches the shape of the sound pickup area of the sound pickup device so as to ensure that the sound absorbing structure can be better attached to the sound pickup area of the sound pickup device, which further improves the sound-pickup blocking effect of the sound pickup device.

In addition, the fixing member includes a rotation shaft connected to the upper cover, at least one snap-fit structure, or includes a drive structure and a control apparatus, so as to facilitate the controlling of the sound absorbing structure to be detached from or attached to the sound pickup area, which then either stops the sound pickup device from picking up sound or resume the sound pickup function of the device, thereby improving the guarding reliability of the sound pickup device.

In addition, the sound absorbing structure may be a sleeve structure to easily control the sleeve structure to rotate. The sound absorbing material is concealed so it is detached from the sound pickup area, or the sound absorbing material is shown so it is adjacent to the sound pickup area. The former stops the sound pickup device from picking up sound while the latter resumes the sound pickup function of the device, thereby improving the guarding reliability of the sound pickup device.

In addition, the sound absorbing structure may include at least one of the mute control lever and the sound pickup control lever so as to control the mute control lever to be against the mute button so that the sound pickup device is unable to pick up sound, and control the sound pickup control lever to be spaced apart from the sound pickup button so that the sound pickup device is in a sound pickup OFF state. The design of the sound absorbing structure improves the sound-pickup blocking reliability of the sound pickup device and further strengthens the security of the sound pickup device.

In an alternate embodiment of the present application, a sound pickup device includes a body having a sound pickup function and a guard apparatus. The guard apparatus comprises a sound absorbing structure and a fixing member. The fixing member is used to fix the guard apparatus to the sound pickup device, and the sound absorbing structure is used to stop the sound pickup device from collecting sound. The guard apparatus may include any of the aforementioned guard apparatuses.

In this embodiment of the present application, the sound pickup device can include a body having a sound pickup function and a guard apparatus. The guard apparatus includes a sound absorbing structure and a fixing member. The sound absorbing structure can prevent the body having the sound pickup function from collecting sound, thereby avoiding compromising user privacy caused by the body's unlimitedly collecting sound. At the same time, the sound absorbing structure also improves the security of sound pickup device. The fixing member can fix the guard apparatus to the sound pickup device, so as to prevent the guard apparatus from becoming loose or coming off from the sound pickup device, thereby improving the effect of the guard apparatus device in stopping the sound pickup device from collecting sound.

In an alternate embodiment of the present application, a sound pickup system includes a sound pickup device and a guard apparatus for the sound pickup device. The guard apparatus comprises a sound absorbing structure and a fixing member. The fixing member is used to fix the guard apparatus to the sound pickup device, and the sound absorbing structure is used to stop the sound pickup device from collecting sound. The guard apparatus may include any of the aforementioned guard apparatuses.

In this embodiment of the present application, the sound pickup system can include a sound pickup device, and a guard apparatus for the sound pickup device. The guard apparatus includes a sound absorbing structure and a fixing member. The sound absorbing structure can stop the sound pickup device from collecting sound, thereby avoiding compromising user privacy when the sound pickup device unlimitedly collects sound and enhancing the security level of sound pickup system. The fixing member can fix the guard apparatus to the sound pickup device, so as to prevent the guard apparatus from coming off from the sound pickup device, thereby improving the effect of the guard apparatus device in stopping the sound pickup device from collecting sound.

Figure 10:
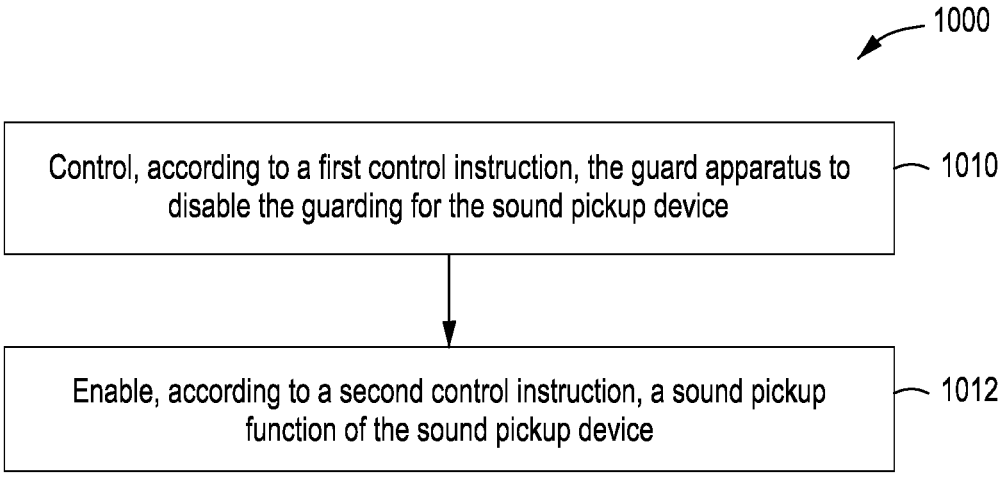
FIG. 10 is a flow chart illustrating an example of a method 1000 of operating guarded sound pickup devices 100, 300, 600, 700, and 800 when equipped with a drive unit that moves the pillars 312 within the pillar grooves 314 in accordance with the present invention.

FIG. 10 shows a flow chart that illustrates an example of a method 1000 of operating guarded sound pickup devices 100, 300, 600, 700, and 800 when equipped with a drive unit that moves the pillars 312 within the pillar grooves 314 in accordance with the present invention. As shown in FIG. 10, method 1000 begins at 1010 to control, according to a first control instruction, the guard apparatus to disable the guarding for the sound pickup device.

In order to avoid the sound receiving device from collecting sound without the user's knowledge and therefore compromising user privacy, and further to enhance the security level of the sound pickup device, the sound pickup device is guarded. The guard of the sound pickup device needs to be disabled when the sound pickup device needs to pick up sound.

The first control instruction is used to instruct the guard apparatus to disable its guarding for the sound pickup device so as to enable the sound pickup device to normally pick up sound. The first control instruction can be triggered by a user performing a button operation, a touch operation, or an input biometric operation.

The sound pickup device may include a physical button, a virtual button on a touch screen or a biometric component to receive the first control instruction. The sound pickup device can be in a communication connection with other electronic devices via a wireless network so as to receive first control instructions from other electronic devices. That is, a user may remotely control the guard apparatus. Other electronic devices may include mobile phones, tablets, or wearable devices.

The sound pickup device can control the guard apparatus to move so as to show the sound pickup area of the sound pickup device, control the guard apparatus not to have a sound-absorbing function, or control the guard apparatus to stop transmitting acoustic or electromagnetic waves. The sound pickup device can therefore properly collect sound via the sound pickup area.

Referring again to FIG. 10, method 1000 next moves to 1012 to enable, according to a second control instruction, a sound pickup function of the sound pickup device. After disabling the guard apparatus from guarding the sound pickup device, the sound pickup device can function normally and collect sound from the environment. Therefore, the sound pickup function of the sound pickup device can be enabled.

The second control instruction is used to enable the sound pickup function so that the sound pickup device picks up sound. The method of triggering the second control instruction is the same as the method used for triggering the first control instruction. The sound pickup device may control the microphone to turn on so as to start collecting sound from the environment. In addition, the guard apparatus can also enable the sound pickup function of the sound pickup device according to the second control instruction, and disable the guarding of the sound pickup device according to the first control instruction.

In this embodiment of the present application, the sound pickup device is provided with the guard apparatus. The sound pickup device may disable the guarding function of the guard apparatus according to the first control instruction, so as to ensure that the sound pickup device can normally pick up sound. At the same time, the sound pickup device may enable the sound-pickup function of the device according to the second control instruction. Therefore, the implementation of the guard apparatus avoids compromising user privacy when the sound pickup device unlimitedly collects sound and enhancing the security level of the sound pickup device.

Figure 11:
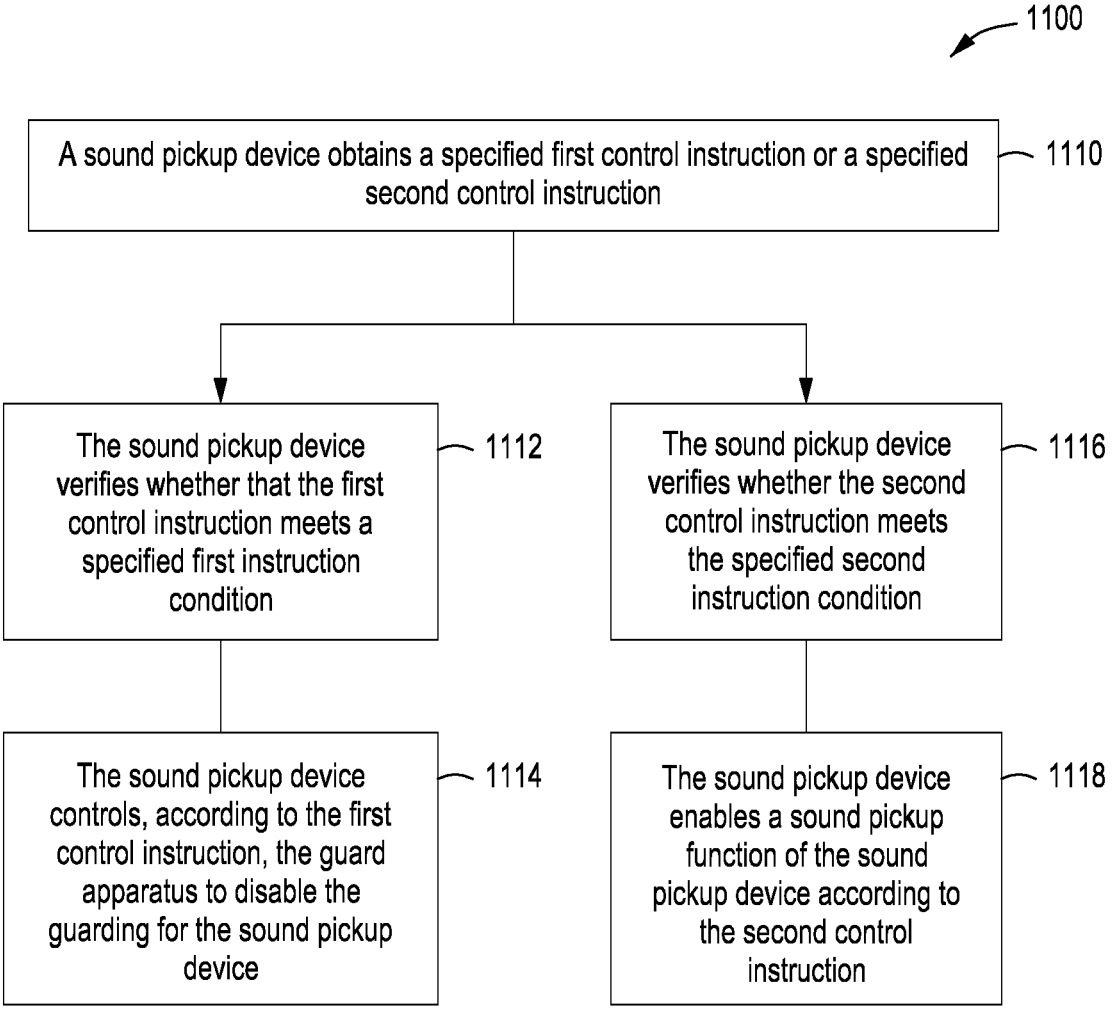
FIG. 11 is a flow chart illustrating an example of a method 1100 of operating guarded sound pickup devices 100, 300, 600, 700, and 800 when equipped with a drive unit that moves the pillars 312 within the pillar grooves 314 in accordance with the present invention.

FIG. 11 shows a flow chart that illustrates an example of a method 1100 of operating guarded sound pickup devices 100, 300, 600, 700, and 800 when equipped with a drive unit that moves the pillars 312 within the pillar grooves 314 in accordance with the present invention. As shown in FIG. 11, method 1100 begins at 1110 where the sound pickup device obtains a specified first control instruction or a specified second control instruction. Method 1100 receives the first and second control instructions in the same manner as previously described.

In order to facilitate the determination of whether to disable the guarding of the sound pickup device so as to make the sound pickup device function normally and pick up sound, the sound pickup device may obtain a first control instruction or a second control instruction. If the first control instruction is obtained, method 1100 moves to 1112 where the sound pickup device verifies whether that the first control instruction meets a specified first instruction condition. Verification reduces the possibilities that the sound pickup device picks up sound without the user's permission or knowledge, i.e., to enhance the security level of the sound pickup device.

The first instruction condition is used to describe the legitimacy of the instruction for controlling the guard apparatus to disable the guarding for the sound pickup device. For example, whether the obtained instruction is a preset instruction for disabling the guarding or whether the object issuing the instruction is a preset object is verified. Therefore, this step avoids the problem that the guarding of the guard apparatus is disabled with illegitimate instructions (including instructions that are not preset for disabling the guarding or instructions that are not issued by the preset object), thereby enhancing the security level of the sound pickup device.

If the first control instruction meets the first instruction condition, it indicates that the first control instruction is legitimate, and the first control instruction is the same as the preset instruction for disabling the guarding, or the first control instruction is from a registered legitimate user. Otherwise, it indicates that the first control instruction is not legitimate.

The first instruction condition may be set in advance by the sound pickup device. For example, a sound pickup device may be set to receive a specified infrared signal or Bluetooth signal as the first instruction condition during the manufacturing process. Afterwards, when the first control instruction is received, the first control instruction may be compared with the infrared signal or Bluetooth signal. If they match, it is determined that the first control instruction meets the first instruction condition. Otherwise, it is determined that the first control instruction does not meet the first instruction condition.

Alternatively, the sound pickup device can be set to receive "disable the guarding" voice data sent by the user as the first instruction condition in advance. That is, the user registers his voice data in the sound pickup device. Afterwards, when receiving voice data as the first control instruction, the sound pickup device determines whether the voice data is the same as the "disable the guarding" voice data. If so, it is determined that the first control instruction meets the first instruction condition and the user sending the first control instruction is the registered legitimate user. Otherwise, it is determined that the first control instruction does not meet the first instruction condition.

Method 1000 next moves from 1112 to 1114 where the sound pickup device controls, according to the first control instruction, the guard apparatus to disable the guarding for the sound pickup device. The guard apparatus can be disabled by, for example, pulling the sound absorbing structure away from the sound pickup area.

Optionally, in order to effectively stop the sound pickup device from collecting sound, and further enhance the security level of the sound pickup device, the guard apparatus can include a sound absorbing structure. When the sound absorbing structure is attached to a sound pickup area of the sound pickup device, the sound absorbing structure stops the sound pickup device from collecting sound. The sound absorbing structure may be fixedly connected to the sound pickup device either detachably or undetachably.

Optionally, in order to enable the sound absorbing structure to be better attached to the sound pickup area of the sound pickup device and further improve the blocking effect of the sound pickup device in picking up sound, the sound absorbing structure may include an upper cover and a sound absorbing material. The upper cover is configured to cover the sound pickup area. The sound absorbing material is disposed on a side where the upper cover is attached to the sound pickup area, and matches the shape of the sound pickup area of the sound pickup device. The upper cover may include any of the aforementioned upper covers; and the sound absorbing material may include any of the aforementioned sound absorbing materials.

Optionally, because the sound pickup device often needs electric power to properly pick up sound and in order to improve the sound-pickup blocking reliability of the sound pickup device, the sound absorbing structure may include an electrical control device and a connector. The electrical control device is connected to a power supply of the sound pickup device via the connector. Accordingly, the sound pickup device can control, according to the first control instruction, the electrical control device to turn off the power of the sound pickup device so as to stop the sound pickup device from collecting sound. When receiving the first control instruction, the sound pickup device can control the electrical control device so as to turn off the power supply of the sound pickup device.

Optionally, when a mute button of the sound pickup device is pressed, the sound pickup device cannot pick up a sound. In order to enhance the sound-pickup blocking reliability of the sound pickup device, the sound absorbing structure may further include a mute control lever, disposed in accordance with a mute button of the sound pickup device.

When the sound absorbing structure is attached to the sound pickup area, the mute control lever is against the mute button of the sound pickup device so that the sound pickup device is in a mute state. Accordingly, the sound pickup device can control, according to the first control instruction, the mute control lever to be away from the mute button of the sound pickup device when the sound absorbing structure is detached from the sound pickup area so that the sound pickup device is in a sound pickup state.

The sound pickup device may control the mute button to be away from the mute button using a similar method of controlling the mute control lever to be against the mute button described previously, so as to ensure that the sound pickup device can function normally and collect sound.

For example, in the sound pickup device provided with the guard apparatus shown in FIG. 8, when receiving the first control instruction, the sound pickup device raises the sound absorbing structure, horizontally rotates the lever body of the mute control lever so that the lever head is in a horizontal state. Later when the sound absorbing structure is lowered, lever body of the mute control lever will not be against the mute button; and the sound pickup device can function normally and pick up sound.

In this embodiment of the present application, in order to prevent the guard apparatus from becoming loose or coming off from the sound pickup device and to improving the effect and reliability in stopping the sound pickup device from collecting sound, optionally, the guard apparatus can also include a fixing member. The fixing member is configured to fix the guard apparatus to the sound pickup device. The fixing member includes a drive structure, which is configured to control the fixing member to move so as to detach the sound absorbing structure from the sound pickup area or to attach the sound absorbing structure to the sound pickup area. Accordingly, the sound device may control, according to the first control instruction, the drive structure to operate so as to control the sound absorbing structure to be detached from the sound pickup area.

In this embodiment of the present application, in order to facilitate the attachment or detachment of the upper cover to and from the sound pickup area of the sound pickup device to stop the sound pickup device from picking up sound or to restore the sound pickup function of the device so as to improve the reliability of guarding the sound pickup device, optionally, the fixing member can include a rotation shaft connected to the end of the upper cover. The sound pickup device may control the rotation shaft to rotate so as to control the fixing member to move, including making the upper cover to move closer or away from the sound pickup area.

In this embodiment of the present application, in order to facilitate the attachment or detachment of the upper cover to and from the sound pickup area of the sound pickup device to stop the sound pickup function of the device or to restore the sound pickup device to pick up sound so as to improve the reliability of guarding the sound pickup device, optionally, the fixing member includes at least one snap-fit structure disposed at the edge of the upper cover. The snap-fit structure includes a pillar and a pillar groove. When the pillar is separated from the pillar groove, the upper cover moves away from the sound pickup area. When the pillar is snap-fitted with the pillar groove, the upper cover is attached to the sound pickup area.

The sound pickup device may control the pillar to be detached from or be snap-fitted with the pillar groove so as to make the upper cover away from or attach to the sound pickup area. Because the better attachment of the sound absorbing material to the sound pickup area, the more effectively the sound is stopped from being transmitted to the sound pickup device, which in turn leads to a better sound-pickup blocking effect of the sound pickup device. In this embodiment of the present application, optionally, in order to further improve the attachment of the sound absorbing material to the sound pickup area, the sound absorbing material can therefore be a soft material so as to match the shape of the sound pickup area. Reference can be made to the previous relevant description for the soft sound absorbing material.

In this embodiment of the present application, in order to easily control whether the upper cover is attached to the sound pickup area of the sound pickup device to determine whether to stop the sound pickup device from picking up sound, optionally, the sound absorbing structure can be a sleeve structure. When the sleeve structure is located at a first rotation position, the sound absorbing material is shown. When the sleeve structure is located at a second rotation position, the sound absorbing material is concealed. The sound pickup device may control the sleeve structure to rotate so as to make the sleeve structure to be at the first rotation position or the second rotation position.

In this embodiment of the present application, in order to quickly control whether to stop sound pickup of the sound pickup device and avoid mechanical wear caused by long-term use, which causes difficulties in accurately controlling the sound absorbing structure to be attached to or detached from the sound pickup area, further reducing the accuracy and reliability in controlling whether to stop the sound pickup of the sound pickup device, optionally, the sound absorbing structure further includes a power supply and a power switch.

When the power is turned on, the sound absorbing material has a sound absorbing function. When the power is turned off, the sound absorbing material does not have the sound absorbing function. Accordingly, the sound pickup device can control the power switch to turn on the power of the sound absorbing material so that the sound absorbing material stops the sound pickup device from picking up sound.

The sound pickup device can also receive a third control instruction so as to control the guard apparatus to disable the guarding for the sound pickup device. The third control instruction is used to instruct the guard apparatus to guard the sound pickup device so as to stop the sound pickup device from collecting sound. The method of obtaining the third control instruction is the same as the method used for obtaining the first control instruction.

Referring again to FIG. 11, if the second control instruction is obtained, method 1100 moves from 1110 to 1116 where the sound pickup device verifies whether that the second control instruction meets a specified second instruction condition. Verification reduces the possibilities that the sound pickup device picks up sound without the user's permission or knowledge, i.e., to enhance the security level of the sound pickup device.

The second instruction condition is used to describe the legitimacy of the instruction for enabling the sound pickup function. For example, whether the obtained instruction is a preset instruction for enabling the sound pickup function or whether the object issuing the instruction is a preset object is verified. Therefore, this step avoids the problem that the sound pickup function is enabled with illegitimate instructions (including instructions that are not preset for enabling the sound pickup function or instructions that are not issued by the preset object), thereby enhancing the security level of the sound pickup device. The method for the sound pickup device to verify the second control instruction is the same as the method used for verifying the first control instruction.

Method 1100 next moves from 1116 to 1118 where the sound pickup device enables a sound pickup function of the sound pickup device according to the second control instruction. The guard apparatus can be enabled by, for example, pushing the sound absorbing structure towards the sound pickup area.

In this embodiment of the present application, when a sound pickup button of the sound pickup device is pressed, the sound pickup device starts picking up sound. In order to enhance the sound-pickup blocking reliability of the sound pickup device, optionally, the sound absorbing structure may further include a sound pickup control lever, disposed in accordance with a sound pickup button of the sound pickup device.

When the sound pickup control lever is spaced apart from the sound pickup button of the sound pickup device, the sound pickup device is in a sound pickup OFF state. The sound pickup device can control, according to the second control instruction, the sound pickup control lever to be in contact with the sound pickup button of the sound pickup device so that the sound pickup device is in a sound pickup state. The method of controlling the sound pickup control lever to be away from the sound pickup button is the same the method used for controlling the mute control lever to be away from the mute button.

The sound pickup device may also receive a fourth control instruction, so as to disable the sound pickup function of the sound pickup device. The fourth control instruction is used to instruct the sound pickup device to disable the sound pickup function so as to stop the sound pickup device from collecting sound. The method of obtaining the fourth control instruction is the same as the method used for obtaining the first control instruction.

In addition, in order to more flexibly and intelligently control the sound pickup device to function normally and pick up sound so as to further enhance the security level and reliability of the sound pickup device, the sound pickup device may control, in a preset time period, the guard apparatus to disable the guarding for the sound pickup device and enable the sound pickup function so that the sound pickup device can function normally and collect sound. That is, through the regular control of disabling the guarding for the sound pickup device and of turning on the sound pickup function, the sound pickup device can function normally and pick up sound for a preset period of time, but not pick up sound for a non-preset period of time. The preset period of time may be determined by the sound pickup device in advance, for example, being determined by receiving the time inputted by the user.

In this embodiment of the present application, first the sound pickup device is provided with the guard apparatus. The sound pickup device can disable the guarding function of the guard apparatus according to the first control instruction so as to ensure that the sound pickup device can normally pick up sound. At the same time, the sound pickup device can enable the sound-pickup function of the device according to the second control instruction. Therefore, the implementation of the guard apparatus avoids compromising user privacy when the sound pickup device unlimitedly collects sound and enhancing the security level of the sound pickup device.

Secondly, the sound pickup device can verify the obtained first control instruction or second control instruction so as to determine whether the first control instruction or second control instruction is a legitimate instruction, thereby avoiding the problem that the guard apparatus is disabled by an illegitimate instruction, or the sound pickup function is enabled by an illegitimate instruction, enhancing the security level of the sound pickup device.

Optionally, in order to help the user to quickly control the sound pickup device, the first control instruction and/or the second control instruction may be infrared signals, Bluetooth signals, or voice data sent over a wireless network. The sound pickup device may be provided with an infrared chip, a Bluetooth chip, or a WIFI chip, so as to receive infrared signals, Bluetooth signals, or voice data sent over a wireless network.

A person skilled in the art may understand that not all of the method steps in the above embodiments are indispensable. In some specific cases, one or more steps may be omitted, as long as the technical purpose of controlling the sound pickup device to pick up sound or not can be implemented. The number of steps in the embodiments and the order thereof in the present application are not limited by the present invention, and the protection scope of the present application is subject to the definition of the claims.

Figure 12:
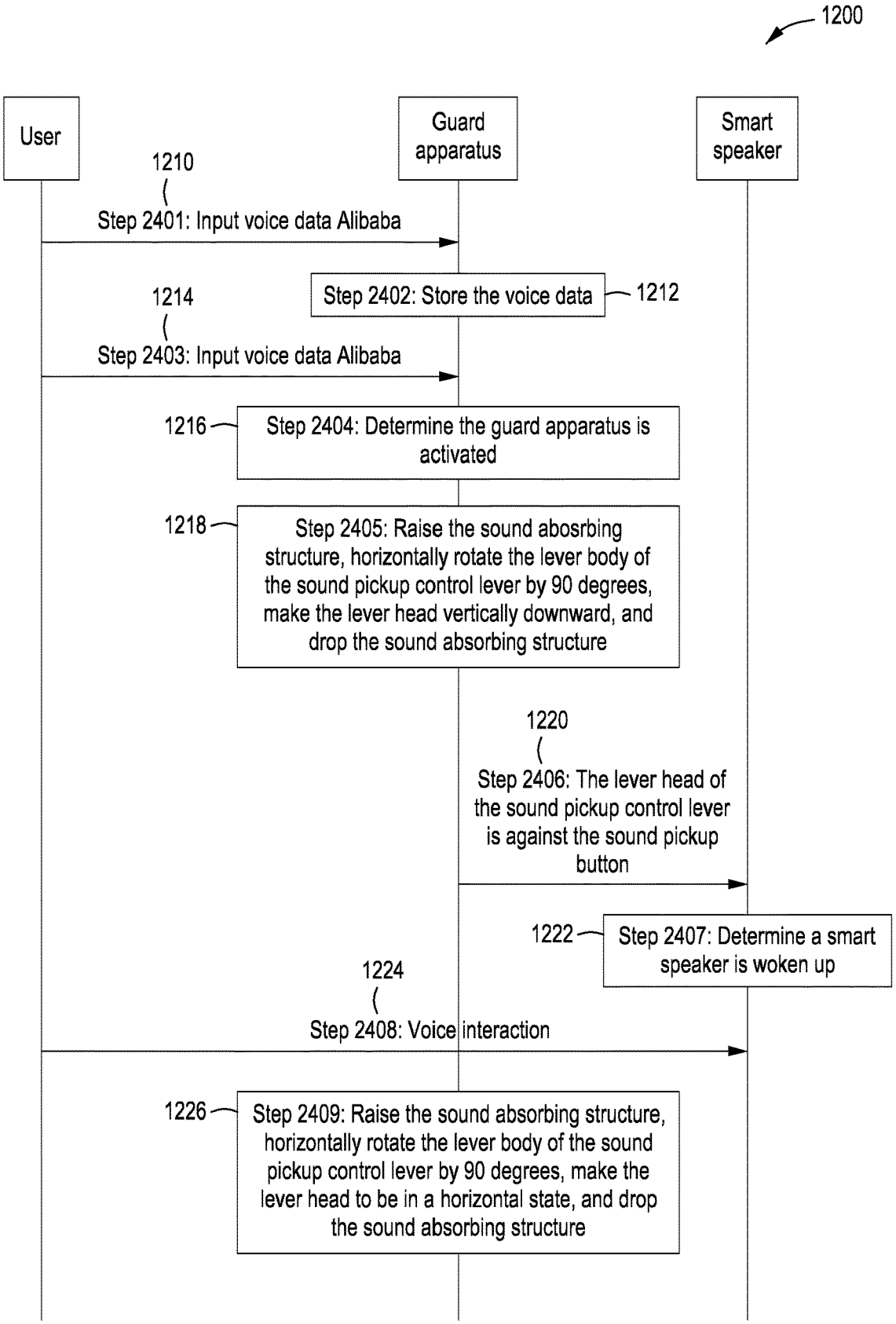
FIG. 12 is a flow diagram illustrating an example of a method 1200 of operating a guarded sound pickup device in accordance with the present invention.

FIG. 12 shows a flow diagram that illustrates an example of a method 1200 of operating a guarded sound pickup device in accordance with the present invention. As shown in FIG. 12, method 1200 begins at step 1210 where a user inputs voice data "Alibaba" to the guard apparatus to register himself at the guard apparatus.

Following this, method 1200 moves to step 1212 where the guard apparatus receives and stores the voice data. Method 1200 next moves to 1214 where the user inputs voice data "Alibaba" to the guard apparatus. After this, method 1200 moves to 1216 where, because the voice data "Alibaba" inputted by the user has been stored earlier, the guard apparatus determines that the current user is a registered, legitimate user after comparing the received voice data with the voice data stored previously. All of the guard apparatuses are determined to be activated.

Next, method 1200 moves to 1218 where the guard apparatus raises the sound absorbing structure, rotates the lever body of the sound pickup control lever by 90 degrees to make the lever head vertically downward, and lowers the sound absorbing structure. Following this, method 1200 moves to 1220 where the lever head of the sound pickup control lever is then against the sound pickup button.

After the sound pickup control lever has been positioned against the sound pickup button, method 1200 moves to 1222 where a smart speaker is determined to be woken up. After this, method 1200 moves to 1224 where the smart speaker performs normal voice interaction with the user. Method 1200 then moves to 1226 where the guard apparatus determines that the smart speaker ends the interaction with the user based on, for example, no interaction occurs during the preset period, or receives the voice data "stops picking up sound" inputted by the user. Therefore, the sound absorbing structure is raised, the lever body of the sound pickup control lever is rotated by 90 degrees to place the lever head in a horizontal state. Next, the sound absorbing structure is lowered, and the guarding is on again.

Figure 13:
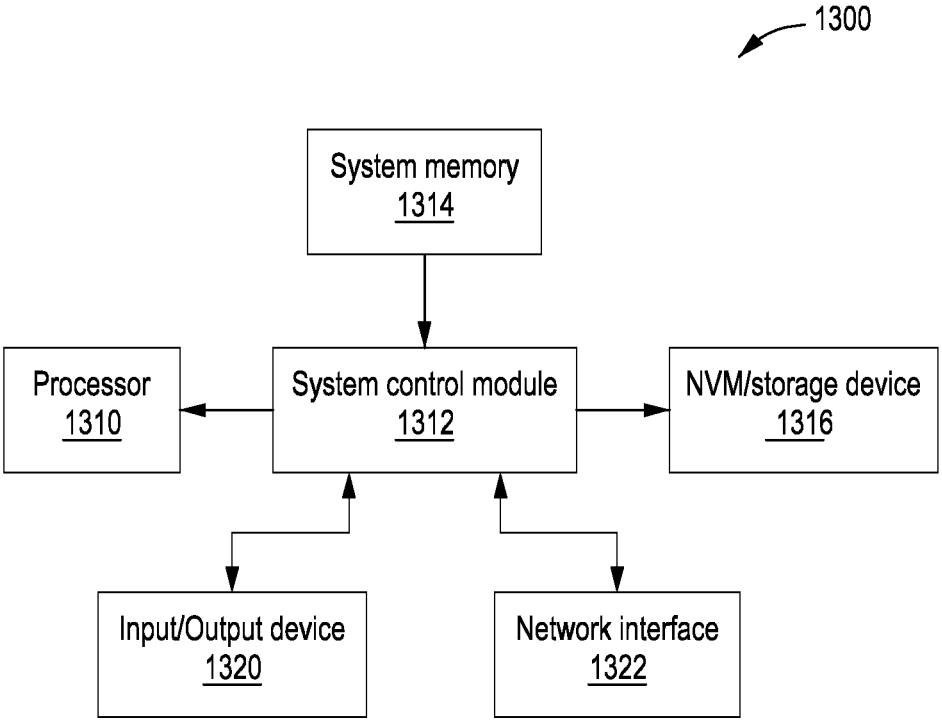
FIG. 13 is a block diagram illustrating an example of a sound blocking system 1300 in accordance with the present invention.

FIG. 13 shows a block diagram that illustrates an example of a sound blocking system 1300 in accordance with the present invention. The embodiments of the present application can be implemented as a system using any suitable hardware, firmware, or software, or any combination thereof to perform desired configurations.

In the FIG. 13 example, sound blocking system 1300 has one or more processors 1310, and at least one system control module (chip set) 1312 coupled to the processor(s) 1310. System 1300 also has a system memory 1314 coupled to the system control module 1312, and a non-volatile memory (NVM)/storage device 1316 coupled to the system control module 1312. In addition, system 1300 has one or more input/output devices 1320 coupled to the system control module 1312, and a network interface 1322 coupled to the system control module 1314.

The processors 1310 may include one or more single-core or multi-core processors. The processors 1310 may include any combination of general purpose processors or special purpose processors (for example, graphics processors, application processors, or baseband processors). In some embodiments, the system 1300 can be used as the guard apparatus or the sound pickup device as described in the embodiments of the present application.

In some embodiments, system 1300 can include one or more computer-readable media (for example, system memory 1314 or NVM/storage device 1316) having instructions and one or more processors 1310 coupled to the one or more computer-readable media and configured to execute the instructions to implement modules so as to perform actions described in the present application.

For one embodiment, system control module 1312 can include any suitable interface controller to provide any suitable interface to at least one of the processor(s) 1310 and/or to any suitable device or component in communication with the system control module 1312. The system control module 1312 can include a memory controller module to provide an interface to system memory 1314. The memory controller module may be a hardware module, a software module, and/or a firmware module.

System memory 1314 can be used to load and store data and/or instructions, for example, for system 1300. For one embodiment, system memory 1314 can include any suitable volatile memory, such as a suitable DRAM. In some embodiments, system memory 1314 can include a double data rate fourth generation synchronous dynamic random-access memory (DDR4 SDRAM).

For one embodiment, system control module 1312 can include one or more input/output controllers to provide an interface to the NVM/storage device 1316 and the input/output device(s) 1320. For example, NVM/storage device 1316 can be used to store data and/or instructions. NVM/storage device 1316 can include any suitable non-volatile memory (for example, a flash memory) and/or may include any suitable non-volatile storage device(s) (for example, one or more hard disk drives (HDDs), one or more compact disc (CD) drives, and/or one or more digital versatile disc (DVD) drives).

NVM/storage device 1316 can include a storage resource that physically forms a part of a device on which the system 1300 is installed, or it may be accessible by the device and not necessarily being a part of the device. For example, NVM/storage device 1316 can be accessed via the input/output device(s) 1320 using a network.

Input/output device(s) 1320 can provide an interface for the system 1300 to communicate with any other suitable devices. Input/output devices 1320 can include a communication component, an audio component, a sensor component, and the like. Network interface 1322 can provide an interface for system 1300 to communicate through one or more networks. System 1300 can wirelessly communicate with one or more components of a wireless network in accordance with any one or more wireless network standards and/or protocols. For example, a wireless network is accessed based on a communication standard like WiFi, 2G, or 3G or a combination thereof to perform wireless communication.

For one embodiment, at least one of the processor(s) 1310 can be packaged together with logic of one or more controllers (for example, the memory controller module) of system control module 1310. For one embodiment, at least one of the processor(s) 1310 can be packaged together with logic of one or more controllers of the system control module 1312 to form a System in Package (SiP). For one embodiment, at least one of the processor(s) 1310 can be integrated on the same die with logic of one or more controllers of system control module 1312. For one embodiment, at least one of the processor(s) 1310 can be integrated on the same die with logic of one or more controllers of system control module 1312 to form a System on Chip (SoC).

In various embodiments, system 1300 can be, but is not limited to, a browser, a workstation, a desktop computing device, or a mobile computing device (for example, a laptop computing device, a hand-held computing device, a tablet computer, or a netbook). In various embodiments, system 1300 may have more or fewer components and/or different structures. For example, in some embodiments, system 1300 can include one or more of a camera, a keyboard, a liquid crystal display (LCD) screen (including a touch screen display), a non-volatile memory port, multiple antennas, a graphics chip, an application specific integrated circuit (ASIC), and a speaker.

If the display includes a touch panel, a display screen can be implemented as a touch screen display to receive input signals from a user. The touch panel includes one or more touch sensors to sense touches, swipes, and gestures on the touch panel. The touch sensors may not only sense a boundary of a touch or swipe action, but also detect a period of time and a pressure related to the touch or swipe operation.

An embodiment of the present application further provides a non-volatile readable storage medium, wherein the storage medium stores one or more modules (programs), which, when applied to a terminal device, enable the terminal device to execute instructions of various method steps in the embodiments of the present application.

An apparatus is provided in an example that includes one or more processors, and one or more machine-readable media having instructions stored thereon. When executed by the one or more processors, the apparatus is enabled to perform a method performed by a guard apparatus or a sound pickup device as in the embodiments of the present application.

Also provided in the example is one or more machine-readable medium having instructions stored thereon. When executed by one or more processors, the instructions enable the apparatus to perform a method performed by a guard apparatus or a sound pickup device as in the embodiments of the present application.

The embodiments of the present application disclose an interaction method based on a sound pickup device or a sound pickup system. Following are 19 examples.

Example 1

An interaction method based on a sound pickup device, wherein a guard apparatus is disposed on the sound pickup device, and the guard apparatus is configured to stop the sound pickup device from collecting sound. The interaction method comprises controlling, according to a first control instruction, the guard apparatus to disable the guarding for the sound pickup device; and enabling, according to a second control instruction, a sound pickup function of the sound pickup device.

Example 2 includes the interaction method of example 1. The first control instruction and/or the second control instruction is an infrared signal, a Bluetooth signal, or voice data sent over a wireless network.

Example 3 includes the interaction method of example 1. Before the controlling, according to a first control instruction, the guard apparatus to disable the guarding for the sound pickup device. The method further comprises verifying whether the first control instruction meets a specified first instruction condition.

Example 4 includes the interaction method of example 1. Before the enabling, according to a second control instruction, a sound pickup function of the sound pickup device, the method further comprises verifying whether the second control instruction meets a specified second instruction condition.

Example 5 includes the interaction method of example 1. Before the controlling, according to a first control instruction, the guard apparatus to disable the guarding for the sound pickup device. The method further comprises obtaining the specified first control instruction or the specified second control instruction.

Example 6 includes the interaction method of example 1. The guard apparatus comprises a sound absorbing structure. When the sound absorbing structure is attached to a sound pickup area of the sound pickup device, the sound absorbing structure stops the sound pickup device from collecting sound.

Example 7 includes the interaction method of example 6. The sound absorbing structure comprises an upper cover and a sound absorbing material. The upper cover is configured to cover the sound pickup area; and the sound absorbing material is disposed on a side where the upper cover is attached to the sound pickup area, and matches a shape of the sound pickup area of the sound pickup device.

Example 8 includes the interaction method of example 6. The sound absorbing structure comprises an electrical control device and a connector. The electrical control device is connected to a power supply of the sound pickup device via the connector; the controlling, according to a first control instruction, the guard apparatus to disable the guarding for the sound pickup device comprises controlling, according to the first control instruction, the electrical control device to turn off the power of the sound pickup device so as to stop the sound pickup device from collecting sound.

Example 9 includes the interaction method of example 6. The sound absorbing structure further comprises a mute control lever, and the mute control lever being disposed in accordance with a mute button of the sound pickup device. When the sound absorbing structure is attached to the sound pickup area, the mute control lever is against the mute button of the sound pickup device so that the sound pickup device is in a mute state.

The method further comprises controlling, according to the first control instruction, the mute control lever to move away from the mute button of the sound pickup device when the sound absorbing structure is detached from the sound pickup area so that the sound pickup device is in a sound pickup state.

Example 10 includes the interaction method of example 6. The sound absorbing structure further comprises a sound pickup control lever, and the sound pickup control lever being disposed in accordance with a sound pickup button of the sound pickup device. When the sound absorbing structure is attached to the sound pickup area, the sound pickup control lever is against the sound pickup button of the sound pickup device so that the sound pickup device is in a sound pickup-off state.

The enabling, according to a second control instruction, a sound pickup function of the sound pickup device comprises controlling, according to the second control instruction, the sound pickup control lever to move away from the sound pickup button of the sound pickup device when the sound absorbing structure is detached from the sound pickup area so that the sound pickup device is in a sound pickup state.

Example 11 includes the interaction method of examples 1-6. The guard apparatus further includes a fixing member, wherein the fixing member is configured to fix the guard apparatus to the sound pickup device. The fixing member comprises a drive structure. The drive structure is configured to control the fixing member to move so as to attach or detach the sound absorbing structure to or from the sound pickup area.

The controlling, according to a first control instruction, the guard apparatus to disable the guarding for the sound pickup device comprises controlling, according to the first control instruction, the drive structure to operate so as to control the sound absorbing structure to be detached from the sound pickup area.

Example 12 includes the interaction method of example 8. The fixing member comprises a rotation shaft connected to the end of the upper cover.

Example 13 includes the interaction method of example 8. The fixing member comprises at least one snap-fit structure disposed on an edge of the upper cover, the snap-fit structure comprises a pillar and a pillar groove. When the pillar is separated from the pillar groove, the upper cover is detached from the sound pickup area. When the pillar is snap-fitted with the pillar groove, the upper cover is attached to the sound pickup area.

Example 14 includes the interaction method of example 7. The sound absorbing material is a soft material to match the shape of the sound pickup area.

Example 15 includes the interaction method of example 7. The sound absorbing structure is a sleeve structure. When the sleeve structure is at a first rotation position, the sound absorbing material is shown. When the sleeve structure is at a second rotation position, the sound absorbing material is concealed.

Example 16 includes the interaction method of example 7. The sound absorbing structure further comprises a power supply and a power switch. When the power is turned on, the sound absorbing material has a sound absorbing function. When the power is turned off, the sound absorbing material does not have the sound absorbing function.

The controlling, according to a first control instruction, the guard apparatus to disable the guarding for the sound pickup device comprises controlling energizing the sound absorbing material through the power switch so that the sound absorbing material stops the sound pickup device from picking up sound.

Example 17

An interaction method based on a sound pickup system, wherein the sound pickup system comprises a sound pickup device and a guard apparatus. The guard apparatus is configured to stop the sound pickup device from collecting sound. The interaction method comprises controlling, according to a first control instruction, the guard apparatus to disable the guarding for the sound pickup device; enabling, according to a second control instruction, a sound pickup function of the sound pickup device.

Example 18

A computer device, comprising a memory, a processor, and a computer program stored on the memory and run on the processor, wherein the processor, when executing the computer program, implements the method according to one or more of the claims.

Example 19

A computer-readable storage medium having a computer program stored thereon, wherein the computer program, when executed by a processor, implements the method according to one or more of the claims.

Although some embodiments are provided for the purpose of explanation and description, various replacements and/or equivalent implementation solutions or computations that achieve the implementation shown and described in the embodiments with the same purpose shall not depart from the implementation scope of the present application. The present application is intended to cover any modifications or changes to the embodiments discussed herein. Therefore, it is apparent that the embodiments described herein are only defined by the claims and their equivalents.

What is claimed is:

1. A guarded sound pickup device comprising:

a sound pickup device that has a sound pickup area;

a sound control structure; and a fixing member that movably connects the sound control structure to the sound pickup device, the sound control structure being movable between a first position adjacent to the sound pickup area and a second position spaced apart from the sound pickup area, wherein the sound pickup device includes a mute button on a surface of the sound pickup device, and the sound control structure includes a mute control lever provided at a position that corresponds with the mute button, and the mute control lever includes a mute lever body and a mute lever head.

2. The guarded sound pickup device of claim 1, wherein the fixing member includes a hinge.

3. The guarded sound pickup device of claim 1 wherein the fixing member includes a rotation shaft that fits within openings integrally formed in the sound control structure and the fixing structure to provide a hinge function.

4. The guarded sound pickup device of claim 1, wherein the sound control structure has an upper cover and a sound absorbing material attached to the upper cover.

5. The guarded sound pickup device of claim 1, wherein the fixing member includes a plurality of pillar grooves that are attached to the sound pickup device.

6. The guarded sound pickup device of claim 5, wherein the fixing member further comprises a plurality of pillars that are attached to the sound control structure, the pillars slide within the pillar grooves such that the sound control structure can move between the first position and the second position.

7. The guarded sound pickup device of claim 5, wherein the sound control structure includes a plurality of pillars that slide within the pillar grooves such that the sound control structure can move between the first position and the second position.

8. The guarded sound pickup device of claim 7, wherein the mute lever head is arranged orthogonally to the mute lever body.

9. The guarded sound pickup device of claim 8, wherein the sound pickup device includes a sound pickup button on a surface of the sound pickup device, and the sound control structure includes a sound pickup control lever provided at a position that corresponds with the sound pickup button, the sound pickup control lever includes a pickup lever body and a pickup lever head arranged orthogonally to the pickup lever body.

10. The guarded sound pickup device of claim 9, wherein when in a sound blocking position, the mute lever head is positioned to be in contact with the mute button, while the pickup lever head is positioned to be spaced apart from the sound pickup button.

11. The guarded sound pickup device of claim 10, wherein when in a sound passing position, the mute lever head is positioned to be spaced apart from the mute button, while the pickup lever head is positioned to be in contact with the sound pickup button.

12. A method of operating a guarded sound pickup device, the method comprising:

placing a sound control structure in a first position adjacent to a sound pickup area of a sound pickup device to limit sound from entering the sound pickup area; and moving the sound control structure away from the sound pickup area, wherein a mute lever is in contact with a mute button in the sound pickup area, and a sound pickup control lever is spaced apart from a sound pickup button in the sound pickup area when the sound control structure is in the first position.

13. The method of claim 12, wherein the sound pickup area is free to pickup sound when the sound control structure has been moved away from the sound pickup area.

14. The method of claim 12, further comprising rotating the mute lever and the sound pickup control lever when the sound control structure is in the second position.

15. The method of claim 14, further comprising moving the sound control structure towards the sound pickup area back to the first position such that the sound pickup control lever is in contact with the sound pickup button, the mute control lever being spaced apart from the mute button.

16. A non-transitory computer-readable medium having computer executable instructions for performing a method for operating a guarded sound pickup device, the method comprising:

placing a sound control structure in a first position adjacent to a sound pickup area of a sound pickup device to limit sound from entering the sound pickup area; and moving the sound control structure away from the sound pickup area, wherein a mute lever is in contact with a mute button in the sound pickup area, and a sound pickup control lever is spaced apart from a sound pickup button in the sound pickup area when the sound control structure is in the first position.

17. The non-transitory computer-readable medium of claim 16, wherein the sound pickup area is free to pickup sound when the sound control structure has been moved away from the sound pickup area.

18. The non-transitory computer-readable medium of claim 17, further comprising:

rotating the mute lever and the sound pickup control lever when the sound control structure is in the second position; and moving the sound control structure towards the sound pickup area back to the first position such that the sound pickup control lever is in contact with the sound pickup button, the mute control lever being spaced apart from the mute button.

* * * * *